US005287775A

United States Patent [19]

Moore

[11] Patent Number: 5,287,775

[45] Date of Patent: Feb. 22, 1994

[54] TORQUE LIMITING DRAWING HOLDER NUT WRENCH

[76] Inventor: Allen M. Moore, P.O. Box 148, Eagle Point, Oreg. 97524

[21] Appl. No.: 947,341

[22] Filed: Sep. 18, 1992

[51] Int. Cl.[5] ..... B25B 13/06

[52] U.S. Cl. ..... 81/121.1; 81/177.1

[58] Field of Search ..... 81/121.1, 177.1, 3.4, 81/119

[56] References Cited

U.S. PATENT DOCUMENTS

| | | | |
|---|---|---|---|
| D. 260,473 | 4/1983 | Rust | D8/17 |
| 3,600,982 | 8/1971 | Tholen | 81/3.4 |
| 4,208,942 | 6/1980 | Henrit | 81/121.1 X |
| 4,392,262 | 8/1987 | McCurdy | 81/119 |
| 4,791,837 | 12/1988 | Main | 81/177.1 X |
| 4,964,319 | 10/1990 | Chang | 81/121.1 X |

*Primary Examiner*—D. S. Meislin

[57] ABSTRACT

This drawing holder nut wrench is made up of a rounded hand grip, a socket body, a socket, and a way to limit torque. The torque is limited by the small size of the hand grip. The hand grip has smoothly rounded projections on it to give a comfortable grip and a shallow mortise in its top shaped to match and aligned with the socket beneath it. The mortise reveals the orientation of the socket beneath without having to turn the wrench over to look at the socket itself. The socket has a generally elongated hexagonal cross section and is a straight sided hole cut upwardly into the bottom of the socket body.

2 Claims, 1 Drawing Sheet

TORQUE LIMITING DRAWING HOLDER NUT WRENCH

BACKGROUND

1. Field of Invention

This invention relates to nut wrenches, specifically to those used to manipulate wingnuts and drawing holder nuts by hand in an office setting.

2. Description of Prior Art

Wing nuts have been used extensively in the past as a direct interface between mechanical threaded members and the people who use them eliminating the need for other tools. This often comes up in Engineering and Architectural offices where drawing holders need tightening and wingnuts are provided to make the human hand an adequate tool to do the job. The intended design is sufficient to tighten most drawing holders to hold ten to fifteen "blue print" drawings, but many orifice applications require holding as many as 100 to 200 drawings in one drawing holder! This has given rise to a variety of wingnut and drawing holder nut wrenches that in some measure fill the need to provide sufficient tightening to hold the desired number of prints in each print holder. This is further complicated by the introduction of large paper copy machines that can produce large drawings on "plain paper"; which has a much lower coefficient of friction. The reintroduction of tools into the drawing holder picture somewhat defeats the purpose of the wingnuts, but they can still be tightened enough to hold the drawings from moving until the tool can be used to provide full tightening.

U.S. Pat. No. Des. 260,473 issued to B. W. Rust provided a wrench with enough leverage to tighten and twist off or strip the threads of most drawing holder bolts and had the additional disadvantage that it could slip under the wing nut when it was partially loosened.

U.S. Pat. No. 4,685,360 issued to Gaylord W. McCurdy solved the problem of the wrench slipping under the nut, but still gives generally a long lever-arm enabling the user to twist off or strip the threads of most drawing holder bolts with relative ease.

Both of these wrenches can easily scratch the print holders as they tighten them and both leave the socket and wing nut exposed while being used. This style of tool also gives the appearance of being part of a mechanics operation and is somewhat incongruous in the office setting.

OBJECTS AND ADVANTAGES

It is therefore an object of the present invention to provide a hand operated drawing holder nut wrench that limits the torque applied to drawing holder nuts. It is a further object to produce a wrench that is pleasing to the eye in an office setting. A further object is to provide a drawing holder nut wrench that can be used easily and conveniently and can tighten these nuts to the appropriate torque. Further objects and advantages of my invention will become apparent from a consideration of the drawings and ensuing description of it.

LIST OF REFERENCE NUMERALS

10: hand grip
12: socket body
14: socket
24: alignment indicator
26: screws

DESCRIPTION OF INVENTION

Figure 1:
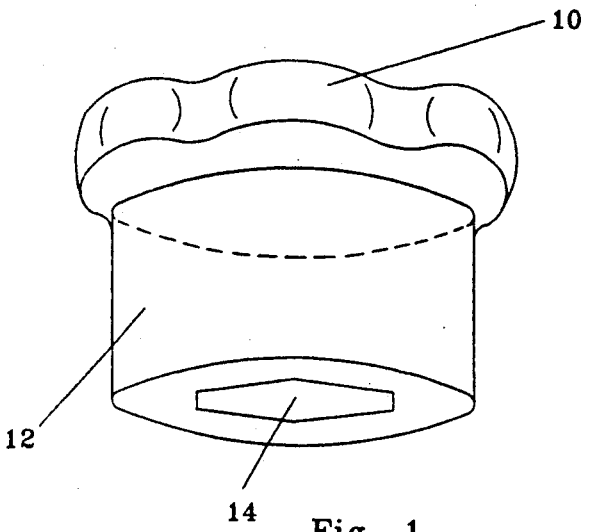
FIG. 1 is the simplest embodiment in a perspective view.

FIG. 1 shows a perspective view of a wrench according to the invention with hand grip 10, substantially attached to socket body 12, and socket 14, visible in socket body 12.

Figure 2:
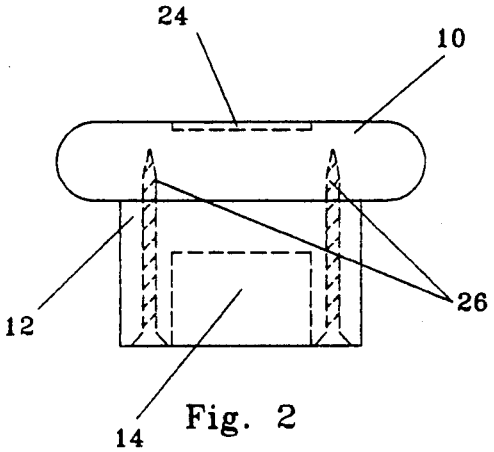
FIG. 2 shows a simplest embodiment in a side view.
Figure 3:
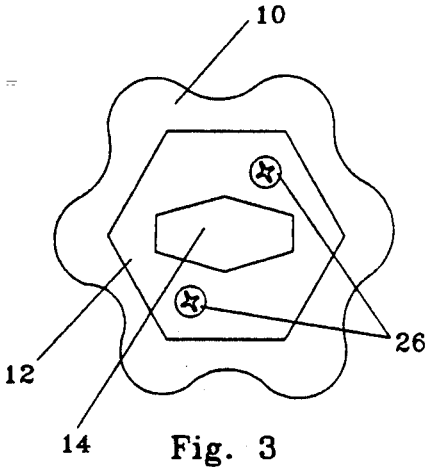
FIG. 3 shows a bottom view.

FIGS. 2 and 3 show two elevational views with screws 26, fastening hand grip 10 to socket body 12. Alignment indicator 24, is shown in the top of hand grip 10, and socket 14 is shown cut into the bottom of socket body 12.

Figure 4:
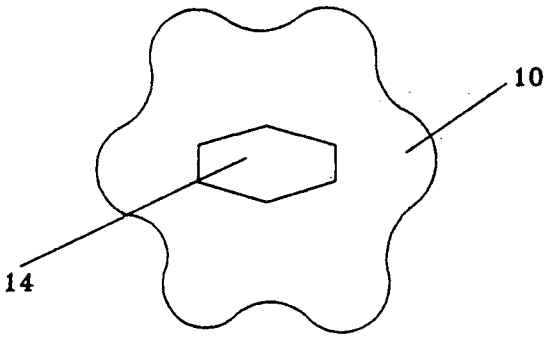
FIG. 4 shows a top view.

FIG. 4 shows alignment indicator 24 cut as a shallow mortise into handgrip 10.

This simple embodiment by it's bulky, compact form limits the user to wrist action to apply torque to the wing nut. This shape provides very little leverage and so the user is more aware of the amount of torque being applied to the nut. A strong person can still twist off a print holder bolt, but can develop a more precise sense of just how much torque the bolt will take before it will break. It also lends itself to construction in hardwood which when highly polished yields an appearance which suits well the office setting.

This embodiment includes an alignment indicator, namely a shallow mortise of the socket's shape, that indicates to the user the orientation of the socket beneath it without turning the wrench over. This embodiment could also be constructed in injection molded plastic.

What is claimed is:

1. A torque limiting drawing holder nut wrench comprising:

a. a disc shaped hand grip having any number of rounded cusps interposed with swales around the outer edge of said disc;

b. provision of a torque transfer limiting means; this supplied by the lack of any extended lever arm;

c. a socket body substantially joined to said hand grip and having a generally cylindrical shape and providing sufficient space within it to accommodate a wing nut socket and having a generally flat and parallel top and bottom;

d. A wing nut socket of a generally elongated hexagonal cross-section said socket being a straight sided hole cut perpendicularly up into said socket body; said socket's cross-sectional shape being more particularly defined as a six sided figure wherein four of the sides are of equal length and the other two are each of generally half the individual length of said four sides; these two short sides being placed opposite and parallel to each other and at 105 degree angles connected at each end to two of the four equal sides; the four equal sides being joined to each other by generally 150 degree angles where they join together; this figure then being a generally oval shape but having six straight sides and being approximately twice as long as it is wide;

e. further comprising in the hand grip surface a shallow mortise aligned with and shaped to match the socket cross-section shape below it in the socket body to allow socket alignment over a wingnut without looking at the socket itself.

2. A wingnut socket wrench comprising:

a. a rounded disc-shaped hand grip component having a series of shallow, rounded, projections along its edge to give a comfortable hand grip, the size of the hand-grip being limited to permit operation only by grasping said hand-grip over its top and having fingers and thumb curving down over the sides between the shallow projections thus limiting the torque being delivered to the socket; said hand grip component further comprising in the hand grip surface a shallow mortise aligned with and shaped to match the socket cross-section shape below it to allow socket alignment over a wingnut without visual reference to the socket itself;

b. a generally cylindrical socket body component substantially joined to said handgrip component having a flat bottom surface and sized to space the human knuckles gripping said handgrip a safe distance above the wing nut device being tightened;

c. a socket cavity within said socket body; being of a generally oval cross-section, more particularly an elongated hexagonal opening composed of six sides, said sides opposing each other in parallel pairs wherein four of the six sides are of equal length and the other two are each of approximately half the individual length of said four sides; these two short sides each abut an adjacent longer side at each end at approximately 105 degree angles, the other end of each longer side being joined to an adjacent long side at approximately 150 degree angles; said cavity having straight sides; these being perpendicular to said bottom surface of said socket body.

* * * * *